US009134097B1

(12) United States Patent
De Gaglia

(10) Patent No.: US 9,134,097 B1
(45) Date of Patent: Sep. 15, 2015

(54) RAPIDLY DEPLOYING BALLISTIC BARRIER CURTAIN

(71) Applicant: John De Gaglia, Coral Springs, FL (US)

(72) Inventor: John De Gaglia, Coral Springs, FL (US)

( * ) Notice: Subject to any disclaimer, the term of this patent is extended or adjusted under 35 U.S.C. 154(b) by 2 days.

(21) Appl. No.: 14/019,515

(22) Filed: Sep. 5, 2013

Related U.S. Application Data

(60) Provisional application No. 61/697,386, filed on Sep. 6, 2012.

(51) Int. Cl.
*F41H 5/24* (2006.01)
*F41H 5/013* (2006.01)
*F41H 5/02* (2006.01)

(52) U.S. Cl.
CPC ..... *F41H 5/24* (2013.01); *F41H 5/013* (2013.01); *F41H 5/02* (2013.01)

(58) Field of Classification Search
CPC ..... F41H 5/24; F41H 5/007; F41H 3/02; F41H 13/0006
USPC ..... 89/36.01, 36.02, 36.03, 36.04, 36.05, 89/36.07, 36.15
See application file for complete search history.

(56) References Cited

U.S. PATENT DOCUMENTS 4,442,780 A * 4/1984 Child ..... 109/29
4,549,464 A 10/1985 Hawkins et al.
5,578,784 A * 11/1996 Karr et al. ..... 89/36.03
5,649,466 A * 7/1997 Genovese ..... 89/1.11
5,867,257 A * 2/1999 Rice et al. ..... 356/28.5
6,029,558 A 2/2000 Stevens et al.
6,266,926 B1 * 7/2001 Figge et al. ..... 52/1
6,279,449 B1 * 8/2001 Ladika et al. ..... 89/36.17
6,470,784 B1 * 10/2002 Bonavita et al. ..... 89/36.17
6,595,102 B2 * 7/2003 Stevens et al. ..... 89/36.17
6,666,124 B2 12/2003 Fleming
7,178,445 B2 2/2007 Wulvik et al.
7,421,936 B2 * 9/2008 Barger et al. ..... 89/36.02
7,458,321 B2 * 12/2008 Bornstein et al. ..... 102/401
7,963,075 B2 6/2011 Howland
8,061,258 B2 * 11/2011 Hoadley et al. ..... 89/36.17
8,082,970 B2 12/2011 Gower
8,281,702 B2 * 10/2012 Hoadley et al. ..... 89/36.17
8,479,432 B2 * 7/2013 Braun ..... 42/106
8,539,875 B1 * 9/2013 Hoadley et al. ..... 89/36.17
(Continued)

FOREIGN PATENT DOCUMENTS

JP 06221796 A * 8/1994 ..... F41H 5/08

*Primary Examiner* — Benjamin P Lee
(74) *Attorney, Agent, or Firm* — Allen D. Hertz, P.A.; Allen D. Hertz

(57) ABSTRACT

A ballistic barrier curtain deployment system deploys a ballistic resistive curtain using a deployment firing mechanism. The ballistic barrier curtain can protect military personnel, equipment, diplomats, celebrities, etc. The deployment firing mechanism utilizes an inflator unit that operates using the same principles as an airbag inflator. The curtain is stored in a barrier curtain storage channel. The deployment firing mechanism is located in a ballistic barrier curtain deployment mechanism integrated at each end of the storage channel. A curtain deployment support column extends vertically from the curtain deployment mechanism. Each edge of the curtain is supported by the support column. The inflator unit is activated upon an activation request from a visual monitor, an audible monitor, heat/thermal monitor, or a manual directive. The inflator unit drives each edge of the curtain vertically, deploying the curtain between the support columns.

20 Claims, 9 Drawing Sheets

(56) References Cited

U.S. PATENT DOCUMENTS

| | | | | |
|---|---|---|---|---|
| 8,677,881 | B2 * | 3/2014 | Tillotson et al. | 89/36.04 |
| 8,788,218 | B2 * | 7/2014 | Soles et al. | 702/36 |
| 8,857,310 | B2 * | 10/2014 | Raiser | 89/36.07 |
| 2002/0152881 | A1 * | 10/2002 | Stevens et al. | 89/36.17 |
| 2008/0216416 | A1 * | 9/2008 | Leano | 52/2.22 |
| 2009/0132098 | A1 * | 5/2009 | Leshem | 700/302 |
| 2009/0158954 | A1 * | 6/2009 | Wardecki et al. | 102/335 |
| 2010/0319524 | A1 * | 12/2010 | Farinella et al. | 89/36.02 |
| 2011/0204145 | A1 * | 8/2011 | Odhner et al. | 235/412 |
| 2011/0239850 | A1 * | 10/2011 | Raiser | 89/36.02 |
| 2012/0036990 | A1 * | 2/2012 | Braun | 89/37.01 |
| 2013/0016449 | A1 * | 1/2013 | Crandall | 361/232 |

* cited by examiner

RAPIDLY DEPLOYING BALLISTIC BARRIER CURTAIN

CROSS-REFERENCE TO RELATED APPLICATION

This Non-Provisional Utility Patent Application claims the benefit of U.S. Provisional Patent Application Ser. No. 61/697,386 filed on Sep. 6, 2012, which is incorporated herein in its entirety.

FIELD OF THE INVENTION

The present disclosure generally relates to a ballistic barrier curtain for protecting individuals. More particularly, the present disclosure relates to a ballistic curtain deployment system for rapidly deploying a ballistic barrier curtain using an actuator comprising airbag deployment technology to protect individuals, including speakers, politicians, celebrities, military combatants, and the like.

BACKGROUND OF THE INVENTION

Certain conditions can expose an individual or a plurality of individuals to potential harm from a ballistic/explosives attack from snipers, assassins, enemy combatants, insurgents, and the like. Key individuals, such as dignitaries, controversial speakers, celebrities, and the like are subject to unwarranted ballistic/explosives attacks. Deployed military personal are continuously subjected to hostile environments with a strong potential of a ballistic/explosives attack.

Currently, a targeted individual is whisked from the exposed setting to a safer location once the attack is initiated. Unfortunately, the attacker is often awarded the advantage of a surprise, thus endangering the target with the initial action. The concerns regarding protecting the target is compounded, as the process of moving the targeted individual(s) takes time. The time could allow firing of multiple shots at the target, substantially increasing the risk of danger to the target.

Another known method of protecting a high-risk target is by placing the individual within a protective barrier, such as a ballistic proof vehicle, behind a ballistic proof barrier such as one or more sheets of polycarbonate resin thermoplastic. Placing the individual within or behind these barriers separates the individual from their audience.

Military combatants are continuously subjected to potential ballistic/explosives attacks. Military combatants are also continuously moving, and are therefore exposed to the potential dangers from exceedingly limited ballistic protection. Military combatants rely upon protective uniforms and accessories (such as helmets, vests, and the like) for protection from the ballistic/explosives attacks. Additional protection is provided by vehicles, structures, and the like. Each of these protective mechanisms has their own limitations.

Merchant sales clerks, bank tellers, and the like can be subjected to armed robberies. Some locations have ballistic-resistant barriers, such as thick sheets of polycarbonate resin thermoplastic located between the customer and the service person. This barrier introduces several limitations, including communications, transfer of items, and the like. A fixed barrier is impractical for conditions where the service person must handle merchandise, for procedures such as scanning a barcode for processing, and the like.

Therefore, what is needed for a barrier system that remains in a consolidated state until necessary, where the barrier is quickly deployed for protecting the targeted individual(s).

SUMMARY OF THE INVENTION

The present disclosure is generally directed to a rapid deploying ballistic barrier curtain system.

In some embodiments, the rapid deploying ballistic barrier curtain system may include:

a barrier curtain storage container having an opening located along an upper portion of a curtain storage section;

a set of ballistic barrier curtain deployment mechanisms, each ballistic barrier curtain deployment mechanism is in communication with a respective end of the barrier curtain storage container;

each ballistic barrier curtain deployment mechanism comprising:

- a curtain deployment support column having a curtain deployment element,
- at least one deployment firing mechanism in fluid communication with the curtain deployment support column,
- an activation controller in signal communication with each of the at least one deployment firing mechanism; and a ballistic barrier curtain having a first edge and a second edge, the first edge in operable communication with the first curtain deployment element and the second edge in operable communication with the second curtain deployment element, wherein in operation, the activation controller directs deployment of the at least one deployment firing mechanism, the at least one deployment firing mechanism discharges a rapid deploying gas which drives the respective ballistic barrier curtain edge towards a distal end of the curtain deployment support column, thus deploying the ballistic barrier curtain.

In another aspect, the deployment firing mechanism comprises functional elements of an airbag.

In yet another aspect, the curtain deployment support column is a rigid vertically oriented column.

In yet another aspect, the curtain deployment support column is a vertically oriented telescoping column.

In yet another aspect, the system can include an inflatable pole that is erected under the direct pressure generated by the initiator.

In yet another aspect, each ballistic barrier curtain deployment mechanism further comprises a primary deployment firing mechanism and a secondary deployment firing mechanism.

In yet another aspect, the rapid deploying ballistic barrier curtain system further comprises a remote control operating device.

In yet another aspect, the rapid deploying ballistic barrier curtain system further comprises a visual monitoring system for providing visual inputs to the operating device.

In yet another aspect, the rapid deploying ballistic barrier curtain system further comprises a heat/thermal monitoring system for providing identification of temperature differentiations that could be used to identify the launch of a projectile as an input to the device.

In yet another aspect, the rapid deploying ballistic barrier curtain system further comprises an audio monitoring system for providing audio inputs to the operating device.

In yet another aspect, the rapid deploying ballistic barrier curtain system further comprises a gas deterrent dispensing element for dispensing a deterrent gas. The deterrent gas can be smoke, colored smoke, fog, a noxious gas, tear gas, a flammable gas, and the like.

In yet another aspect, the rapid deploying ballistic barrier curtain system further comprises an audible deterrent dispensing element for emitting a noxious sound. The sound would be directed away from the potential target to distract audience members, allowing the potential target time to relocate.

In yet another aspect, the deployment system can include a deployment member attached to each respective curtain side edge.

In yet another aspect, the deployment member is provided in a shape of a ring, wherein the ring is assembled about a vertically oriented column within the curtain deployment support column.

In yet another aspect, the deployment member comprises a plurality of rings.

In another aspect, the activation controller further comprises a wireless communication system.

In another aspect, the activation controller further comprises a directly wired, "hard-wired" controller mechanism. The wired communication can be provided by electrically conductive wires, optical communications (such as fiber-optic cabling), and the like.

In yet another aspect, the curtain deployment support column further comprises a deployment dampening system located at a distal end of thereof.

In yet another aspect, the deployment dampening system can include a dampening member, such as a spring, a dampening device (such as a shock absorbing device), and the like.

In yet another aspect, the curtain deployment support column further comprises an upper curtain support ring retention element located at a distal end of thereof.

In yet another aspect, the curtain deployment support column further comprises a column deployment distal stop at a distal end of thereof.

In yet another aspect, the curtain deployment support column further comprises a firing exhaust port located at a distal end of thereof.

The rapid deploying ballistic barrier curtain system provides several advantages over the current art. The rapid deploying ballistic barrier curtain system provides a concealed ballistic protection system that can be quickly deployed. The deployment can be activated upon an audio detected event, a visually detected event, a manually requested deployment, and the like.

BRIEF DESCRIPTION OF THE DRAWINGS

The invention will now be described, by way of example, with reference to the accompanying drawings in which.

Like reference numerals refer to like parts throughout the several views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
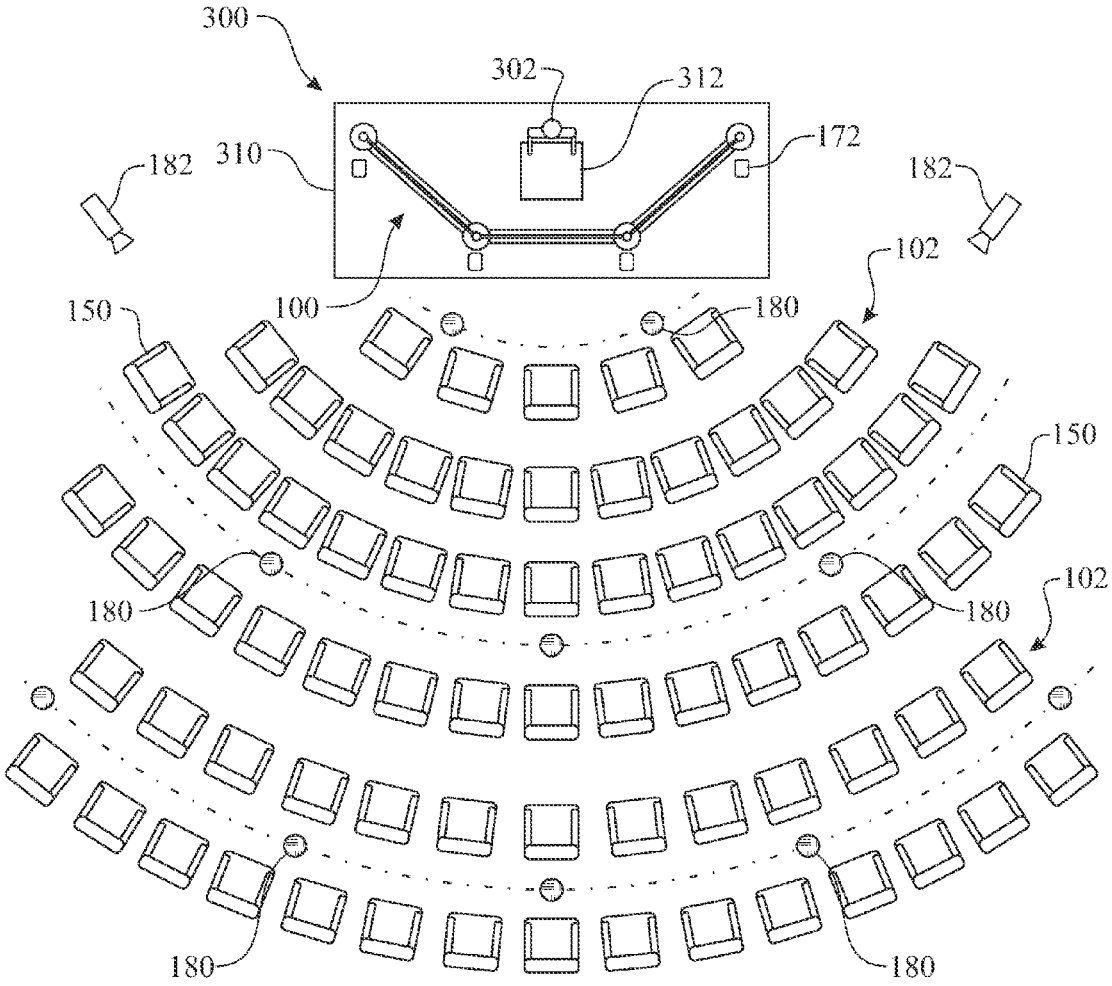
FIG. 1 illustrates a top plan view of an exemplary rapid deploying ballistic barrier curtain system deployed in a venue.

A ballistic barrier curtain deployment system 100 can be employed for protection of one or more individuals or objects in any of many environments, such as within a venue as illustrated in FIG. 1. The ballistic barrier curtain deployment system 100 can be used to protect dignitaries, military personnel, merchants, bank employees, and the like. The ballistic barrier curtain deployment system 100 enables unencumbered relations between the potential target and the general public, while providing protection to the potential target upon identification of a concerning event.

The illustrated exemplary environment is an auditorium comprising a plurality of seats 150 for accommodating an audience 102. The plurality of seats 150 is arranged orienting the audience 102 facing a speaker 302. The ballistic barrier curtain deployment system 100 is placed to at least partially surround the speaker 302. The ballistic barrier curtain deployment system 100 would be arranged to provide a barrier between the speaker 302 and the audience 102, ensuring that the speaker 302 is protected from any potential shooting location within the audience 102. In a preferred configuration, a ballistic protective stage 300 is provided to support the ballistic barrier curtain deployment system 100 and the speaker 302. The exemplary ballistic protective stage 300 includes a platform 310, elevating the speaker 302 above a floor for improved visibility of the speaker 302 by the audience 102. The platform 310 additionally supports a podium 312. The podium 312 can be fabricated of a ballistic resistant material to help protect the speaker 302.

Figure 2:
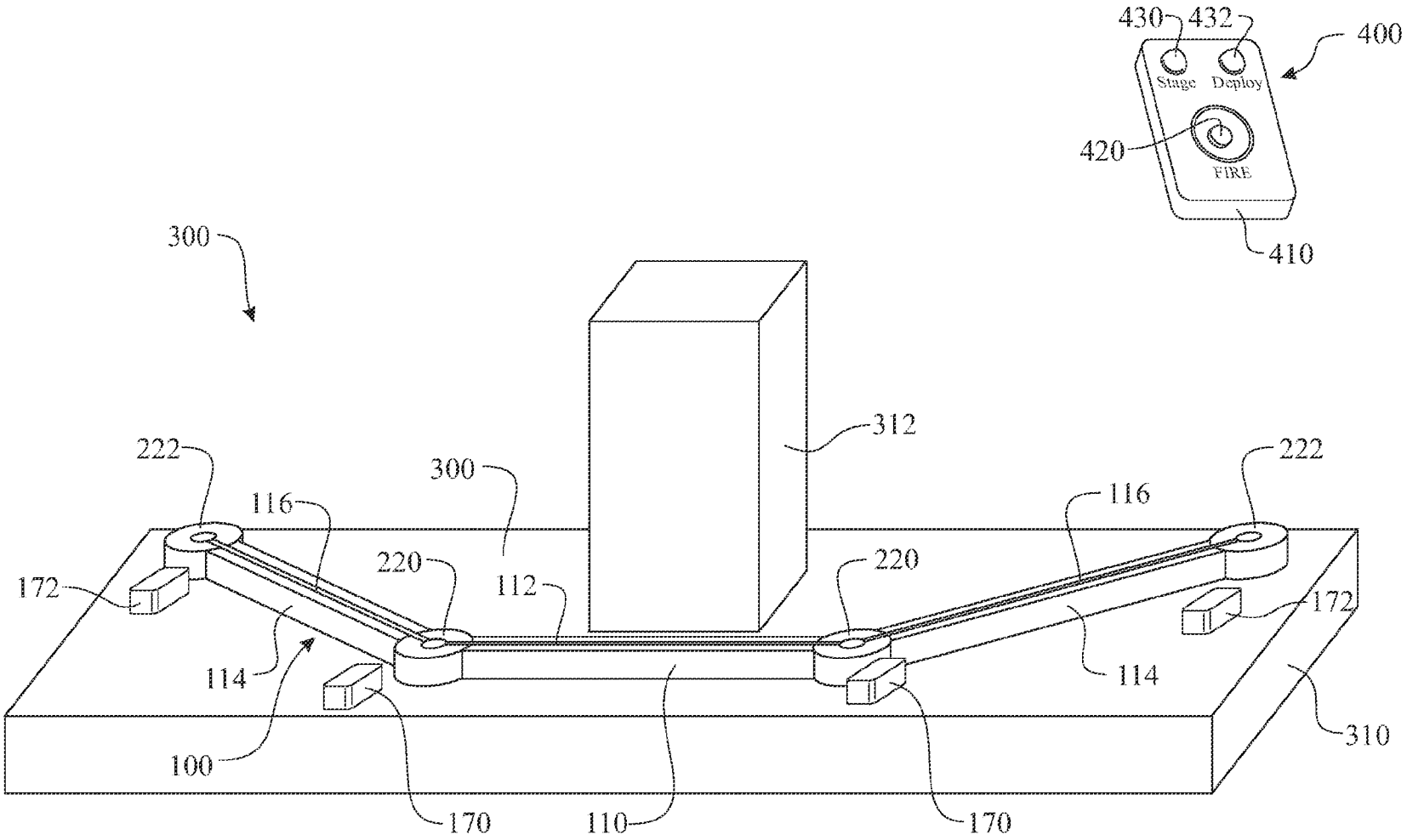
FIG. 2 illustrates an isometric front view of the rapid deploying ballistic barrier curtain system deployed on a stage, wherein the rapid deploying ballistic barrier curtain system is illustrated in a staged configuration.
Figure 3:
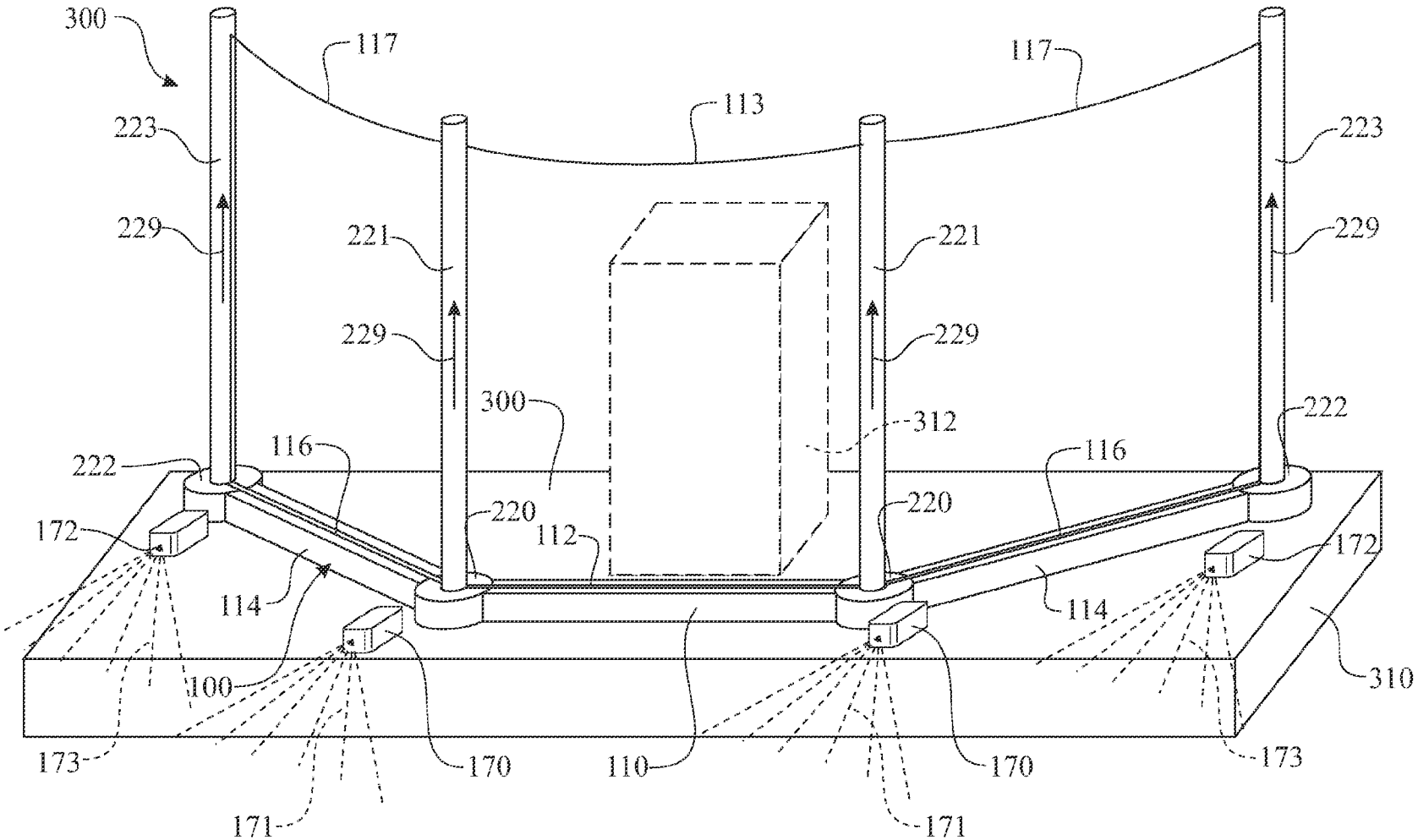
FIG. 3 illustrates an isometric front view of the rapid deploying ballistic barrier curtain system deployed on a stage, wherein the rapid deploying ballistic barrier curtain system is illustrated in a deployed configuration.

Details of the ballistic barrier curtain deployment system 100 are presented in FIGS. 1 through 3. The ballistic barrier curtain deployment system 100 includes at least one barrier curtain storage container 110, 114. Each barrier curtain storage container 110, 114 includes a curtain storage section for storing a ballistic barrier curtain 113, 117 therein and a barrier curtain storage channel 112, 116 enabling deployment of the ballistic barrier curtain 113, 117 from within the curtain storage section. The barrier curtain storage container 110, 114 would be sized and shaped to adequately store and transport the ballistic barrier curtain 113, 117. The ballistic barrier curtain(s) 113, 117 would be fabricated of a pliant, ballistic-resistant material, such as any fabric woven from aramid fiber, which includes material sold under the trade names NOMEX, KEVLAR, and the like. It is understood that the ballistic barrier curtain deployment system 100 can include a plurality of ballistic barrier curtains 113, 117 arranged as a series of layers to ensure any ballistic projectiles are stopped. One exemplary embodiment of a layered curtain configuration is presented in FIG. 8, where a redundant ballistic barrier curtain 123 is located in a parallel configuration with the primary ballistic barrier curtain 113. Alternatively, the ballistic protective stage 300 can include a plurality of ballistic barrier curtain deployment systems 100 arranged to provide the series of layers, such as the exemplary configuration presented in FIG. 9. A redundant ballistic barrier curtain deployment systems 101 can be deployed in parallel with the ballistic barrier curtain deployment systems 100.

Several additional system support elements can be deployed in the auditorium, including an audio monitoring system 180, a visual monitoring system 182, a thermal detection system, and a gas deterrent dispensing element central gas deterrent dispensing element 170 (FIGS. 2, 3), 172. The deterrent system can be modified to present either in conjunction with or alternatively to the gas, a light emitting system, a noxious noise emitting system, and the like. These elements can provide monitoring support to monitor for and determine when a deployment condition arises, provide additional protection for a potential target, and the like. Details will be described later herein.

The ballistic barrier curtain deployment system 100 includes a central ballistic barrier curtain deployment mechanism 220 located at each end of a central barrier curtain storage container 110. The ballistic barrier curtain deployment system 100 can be expanded to include at least one side barrier curtain storage container 114. Each side barrier curtain storage container 114 would be integrated into the central ballistic barrier curtain deployment mechanism 220 at a first end and would include a side ballistic barrier curtain deployment mechanism 222 at a second, opposite end thereof. The central ballistic barrier curtain deployment mechanism 220, 222 would be configured to support one or two curtains, based upon the application.

The 220, 222 includes a deployment system that raises the ballistic barrier curtain(s) 113, 117 in accordance with a curtain deploying motion 229. Each vertical edge of the ballistic barrier curtain(s) 113, 117 is supported by a curtain deployment support column 221, 223. The deployment extends the vertical edge of the ballistic barrier curtain(s) 113, 117 along a length of each curtain deployment support column 221, 223. The ballistic barrier curtain(s) 113, 117 would be retained by one or more curtain retention members.

The ballistic barrier curtain deployment system 100 can be provided in any of a variety of configurations. A first exemplary configuration utilizes a central ballistic barrier curtain deployment mechanism 220, which is detailed in FIGS. 2 through 5. A second exemplary configuration utilizes a ballistic barrier curtain deployment mechanism 520, which is detailed in FIGS. 6 through 8. The central ballistic barrier curtain deployment mechanism 220 and ballistic barrier curtain deployment mechanism 520 include a number of like elements Like features of the ballistic barrier curtain deployment mechanism 520 and central ballistic barrier curtain deployment mechanism 220 are numbered the same except preceded by the numeral '5'.

Figure 4:
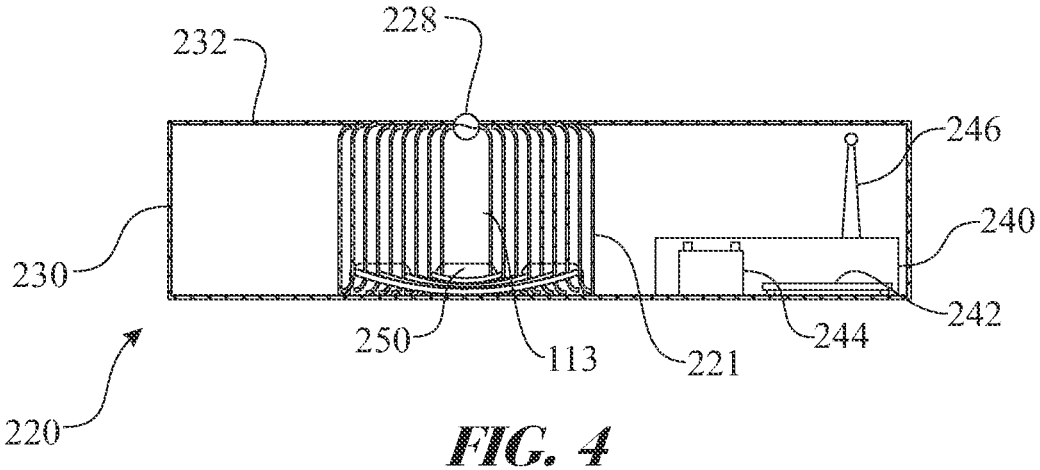
FIG. 4 illustrates a sectioned elevation view of a first exemplary ballistic barrier curtain deployment mechanism, wherein the ballistic barrier curtain deployment mechanism is illustrated in a staged configuration.
Figure 5:
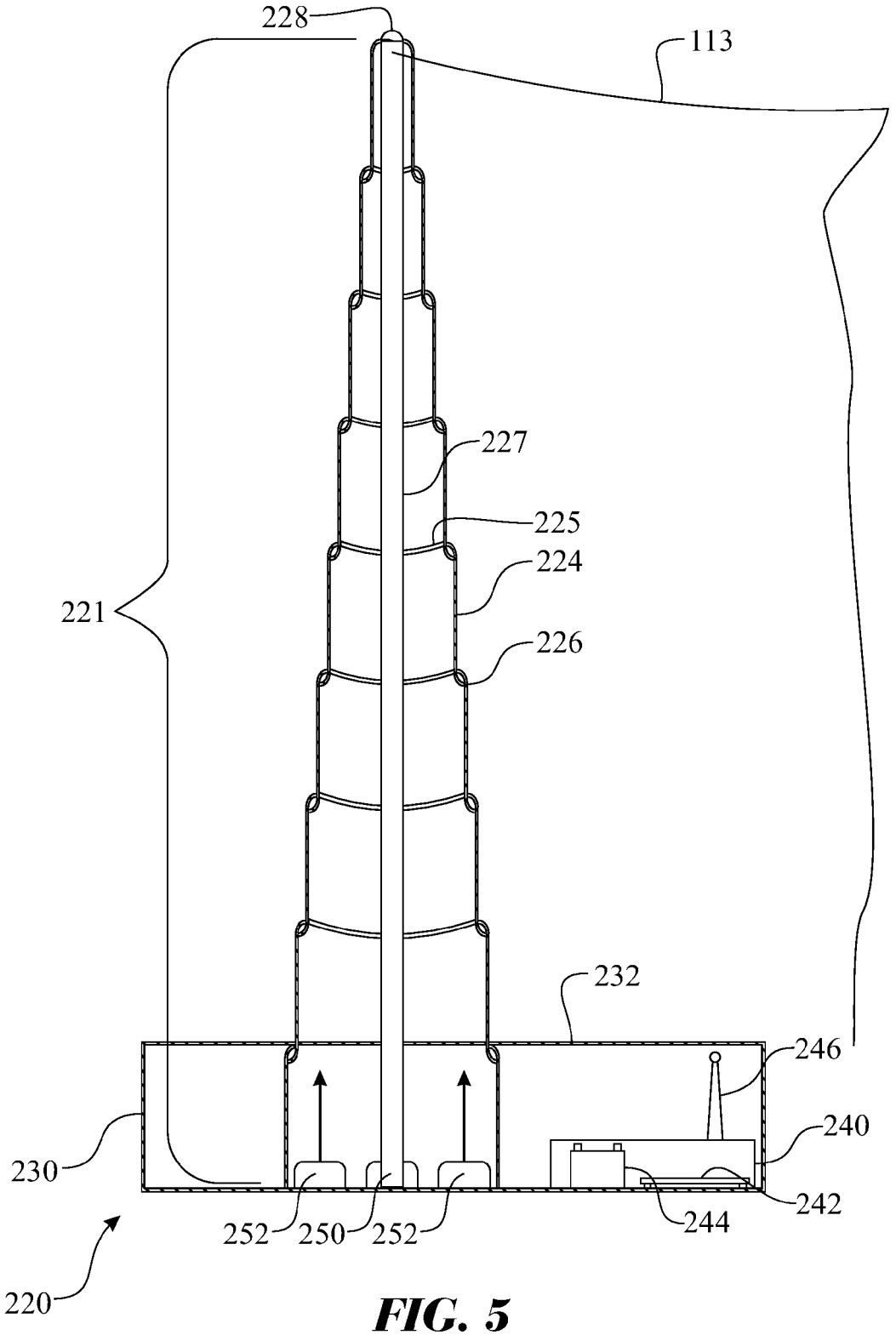
FIG. 5 illustrates a sectioned elevation view of the first exemplary ballistic barrier curtain deployment mechanism, wherein the ballistic barrier curtain deployment mechanism is illustrated in a deployed configuration.

Details of the ballistic barrier curtain deployment mechanism 220, 222 are presented in exemplary illustration of central ballistic barrier curtain deployment mechanism 220 shown in FIGS. 4 and 5. The central ballistic barrier curtain deployment mechanism 220 includes operational elements carried by a deployment mechanism enclosure 230. The deployment mechanism enclosure 230 can be defined having a deployment enclosure upper surface 232 and a deployment enclosure base surface 234. An activation controller 240 provides a communication interface from or between a remote activation device and includes circuitry for directing and controlling deployment of the ballistic barrier curtain 113, 117. The activation controller 240 can include an activation controller printed circuit assembly 242 comprising the operational controlling circuitry, communication circuitry, power management circuitry, and the like. Electrical power is provided to the ballistic barrier curtain deployment system 100 for operating the electrical components. Electrical power can be provided by an external power source or, preferably, by integrated a portable power source 244 within the activation controller 240. The portable power source 244 is preferably included enabling autonomy and portability of the ballistic barrier curtain deployment system 100. The activation controller printed circuit assembly 242 includes circuitry to direct deployment of the central curtain deployment support column 221 and respective central ballistic barrier curtain 113, 117. A wireless interface 246 can be integrated into the activation controller 240 to provide communication of the activation controller printed circuit assembly 242 with a remote activation device. It is understood that the system can utilize a wired interface in place of or as a redundant system to the wireless interface.

The ballistic barrier curtain 113, 117 is deployed by activating at least one deployment firing mechanism 250, 252. The at least one deployment firing mechanism 250, 252 includes components similar to an airbag. It is preferred that the ballistic barrier curtain deployment mechanism 220 can include a primary deployment firing mechanism 250 and at least one redundant deployment firing mechanism 252 to ensure proper deployment when needed.

When the ballistic barrier curtain 113, 117 is to deploy, a signal is sent to an inflator unit or the primary deployment firing mechanism 250 integrated within the deployment mechanism enclosure 230. An igniter starts a rapid chemical reaction generating primarily nitrogen gas (N2) to fill the central curtain deployment support column 221 making it deploy from the deployment enclosure upper surface 232 of the deployment mechanism enclosure 230. Some airbag technologies use compressed nitrogen or argon gas with a pyrotechnic operated valve ("hybrid gas generator"), while other technologies use various energetic propellants. Propellants containing the highly toxic sodium azide (NaN3) were common in early inflator designs.

The azide-containing pyrotechnic gas generators contain a substantial amount of the propellant. The driver-side airbag would contain a canister containing about 50 grams of sodium azide. The passenger side container holds about 200 grams of sodium azide.

The alternative propellants may incorporate, for example, a combination of nitroguanidine, phase-stabilized ammonium nitrate (NH4NO3) or other nonmetallic oxidizer, and a nitrogen-rich fuel different than azide (e.g. tetrazoles, triazoles, and their salts). The burn rate modifiers in the mixture may be an alkaline metal nitrate (NO3-) or nitrite (NO2-), dicyanamide or its salts, sodium borohydride (NaBH4), etc. The coolants and slag formers may be e.g. clay, silica, alumina, glass, etc. Other alternatives are e.g. nitrocellulose based propellants (which have high gas yield but bad storage stability, and their oxygen balance requires secondary oxidation of the reaction products to avoid buildup of carbon monoxide), or high-oxygen nitrogen-free organic compounds with inorganic oxidizers (e.g., di or tricarboxylic acids with chlorates (ClO3-) or perchlorates (ClO4-) and eventually metallic oxides; the nitrogen-free formulation avoids formation of toxic nitrogen oxides).

From the onset of the directive for activation, the entire deployment process is estimated to be about 0.04 seconds. This rapid deployment minimizes the time between a triggering event and deployment, thus significantly reducing any potential of a ballistic projectile impacting the protected individual, plurality of individuals, or object.

The deployment process expands a gas. The gas raises the ballistic barrier curtain 113, 117. The ballistic barrier curtain 113, 117 would be carried by an element that is raised by the expanding gas.

In one embodiment, the curtain raising element would comprise a series of telescoping column segments 224, wherein each telescoping element would be spatially attached along a length of the respective vertical curtain edge. Each telescoping column segment 224 includes a telescoping column segment extension aperture 225 at a first end and a telescoping column segment extension limiter 226 proximate a second, opposite end. A curtain support channel 227 extends axially between the telescoping column segment extension aperture 225 and the telescoping column segment extension limiter 226. The telescoping column segments 224 would telescope axially upon expansion of the activated combination of gases. The telescoping column segment extension limiter 226 engages with the telescoping column segment extension aperture 225 to limit the movement of each of the telescoping column segments 224. A deployment stop element 228 would be located at the distal end of the central curtain deployment support column 221. The deployment stop element 228 can include a vent or other pressure relief mechanism to avoid potential damage to the central curtain deployment support column 221 from the expanding gas.

Figure 6:
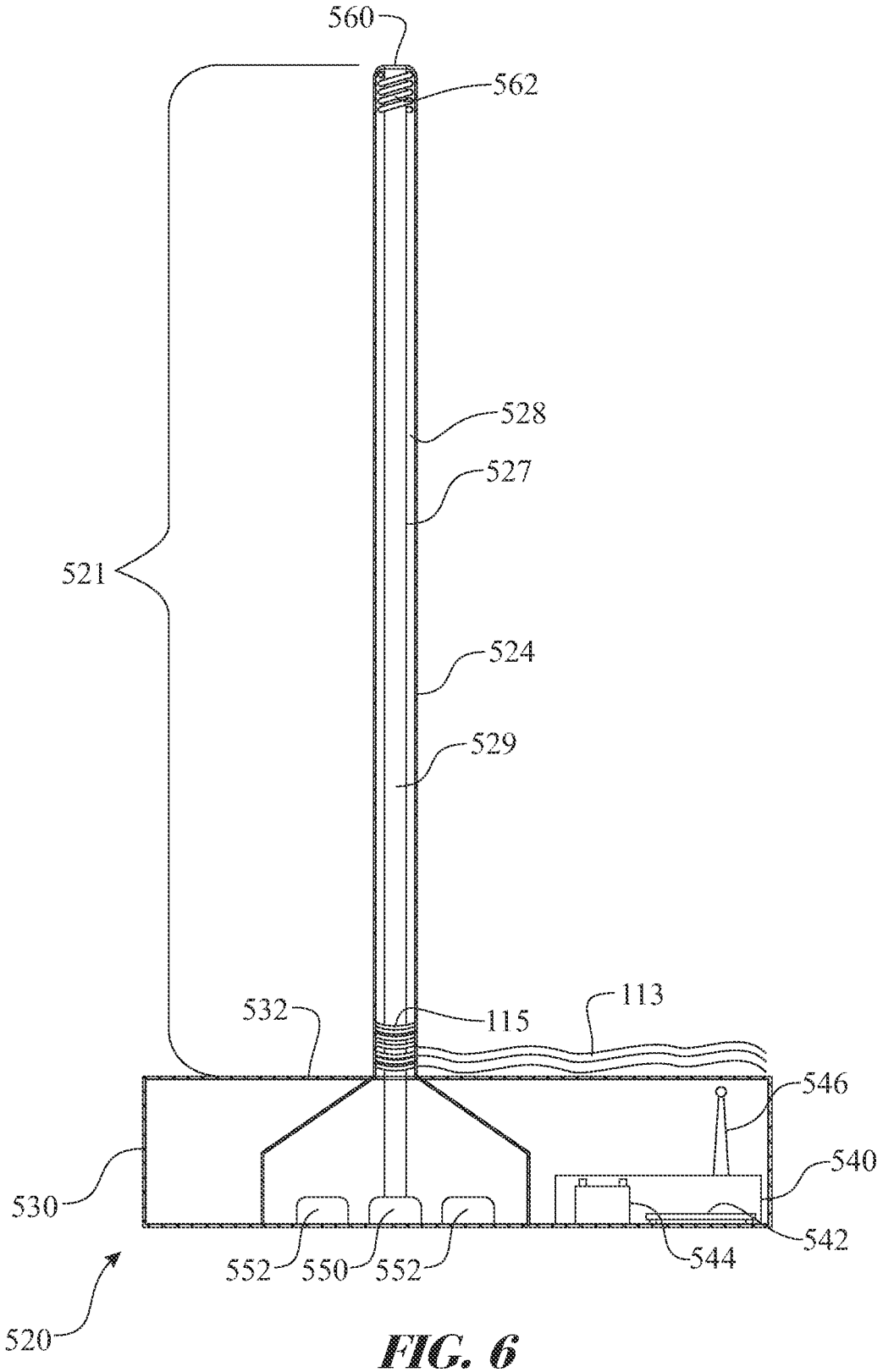
FIG. 6 illustrates a sectioned elevation view of a second exemplary ballistic barrier curtain deployment mechanism, wherein the ballistic barrier curtain deployment mechanism is illustrated in a staged configuration.
Figure 7:
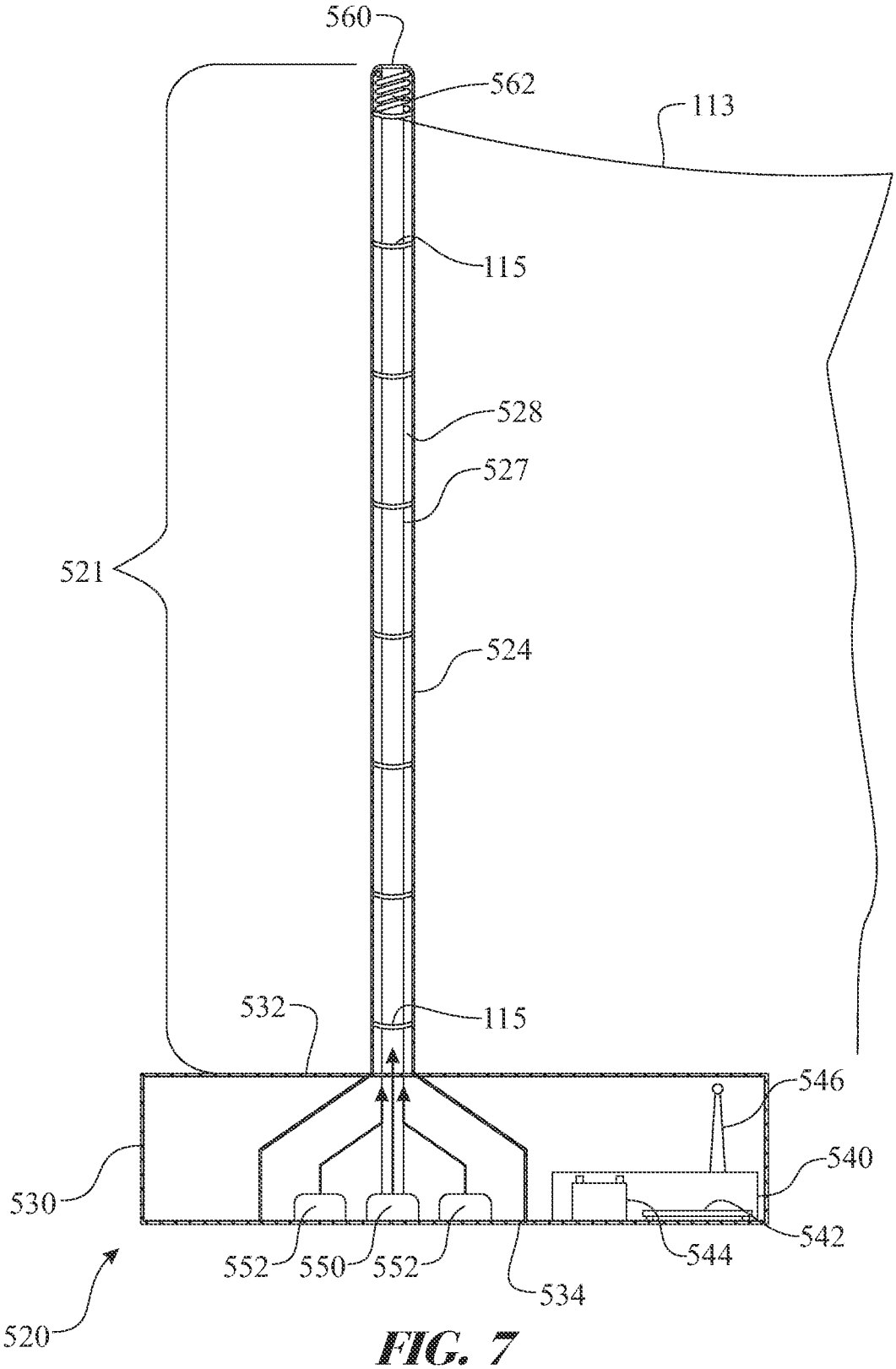
FIG. 7 illustrates a sectioned elevation view of the second exemplary ballistic barrier curtain deployment mechanism, wherein the ballistic barrier curtain deployment mechanism is illustrated in a deployed configuration.
Figure 8:
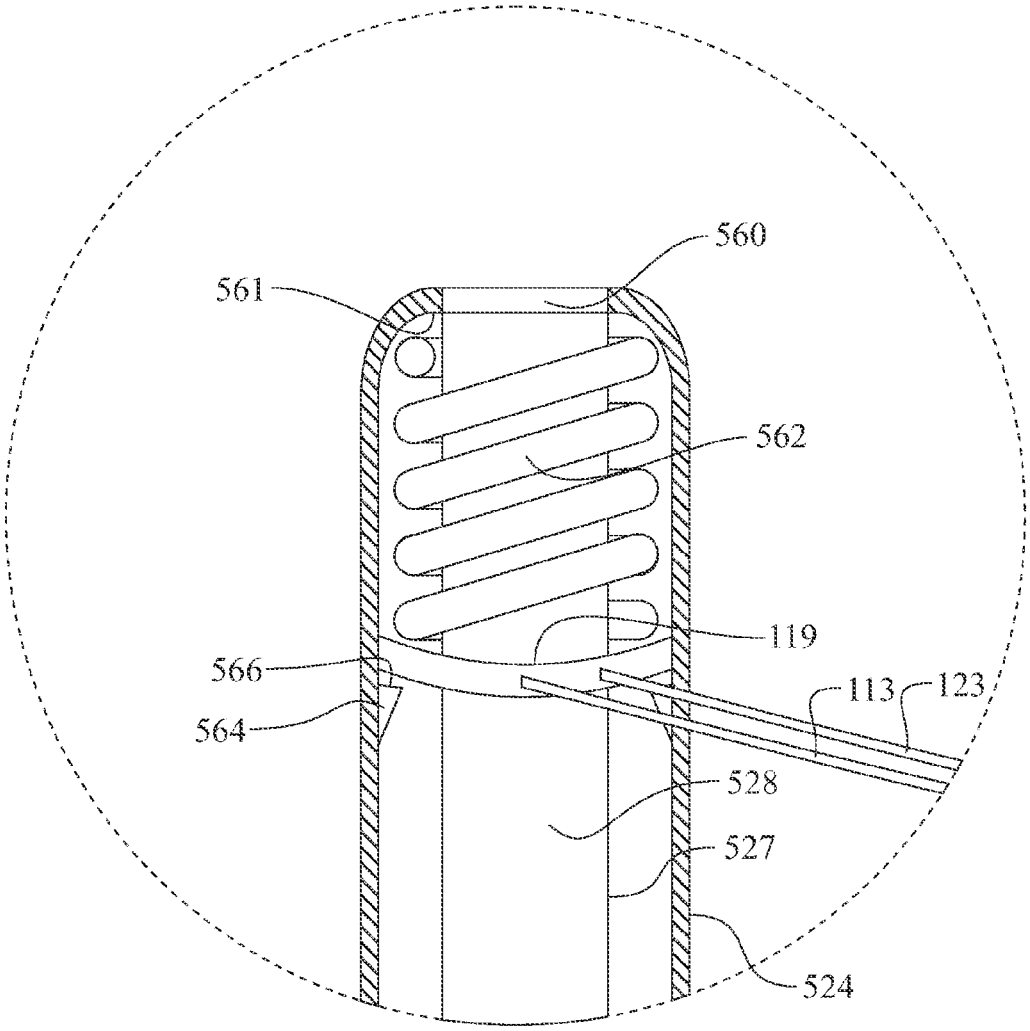
FIG. 8 illustrates an enlarged sectioned elevation view of a deployment dampening portion of the second exemplary ballistic barrier curtain deployment mechanism.
Figure 9:
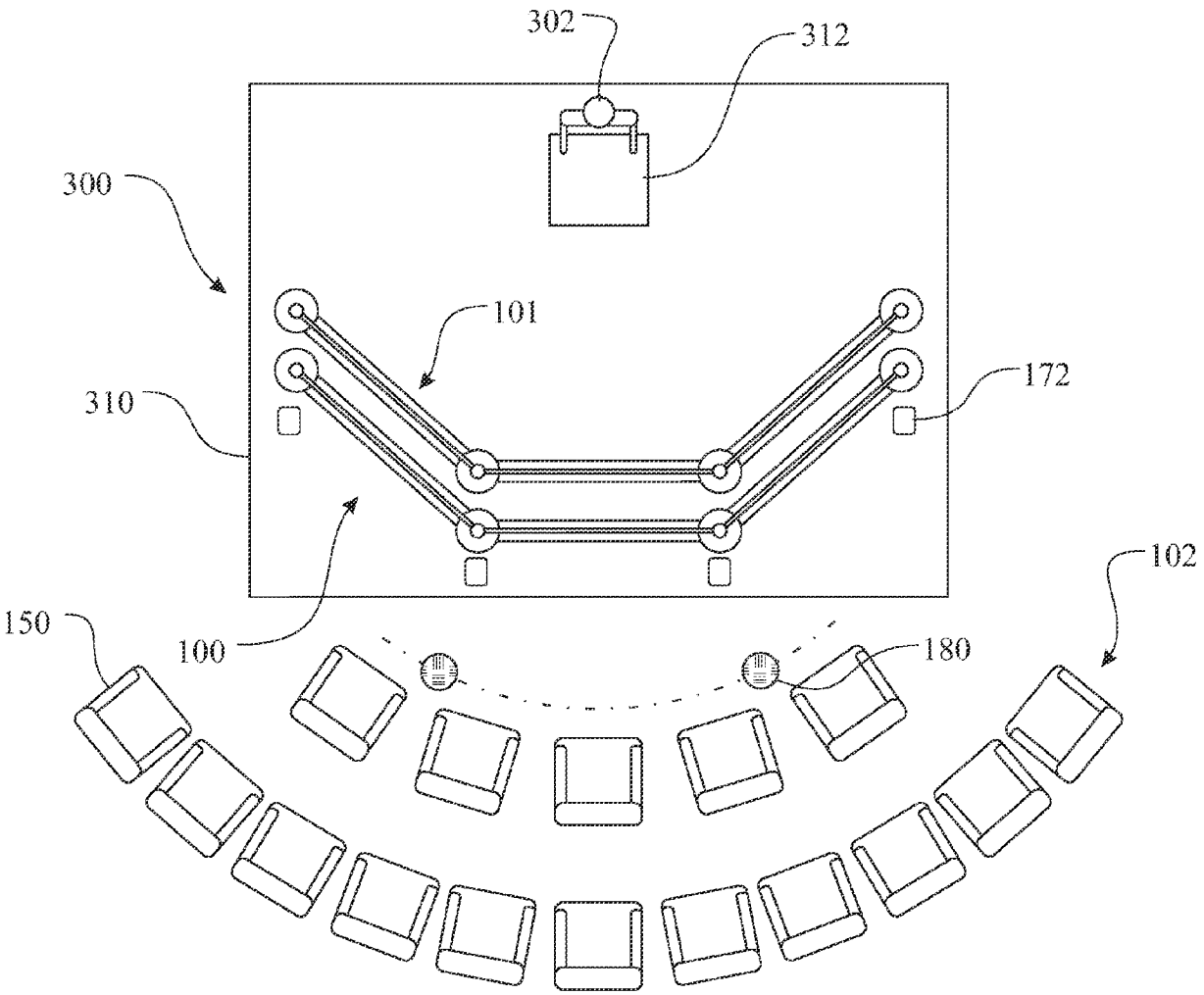
FIG. 9 illustrates a top plan view of the exemplary rapid deploying ballistic barrier curtain system deployed in a venue and introduces a redundant rapid deploying ballistic barrier curtain system.

In another embodiment, the curtain raising element would comprise a series of curtain deployment support rings 115 as illustrated in FIGS. 6 through 8. The curtain deployment support rings 115 would slide axially along a curtain support column 527. The curtain support column 527 would be encased within a tubular column 524. A deployment firing tunnel 528 would be formed between an exterior surface of the curtain support column 527 an interior surface of the tubular column 524. The expanding gas would be directed into the deployment firing tunnel 528 by a deployment force collector 536. The tubular column 524 is preferably fabricated of rigid tubular material. A deployment feature can be integrated into the distal ring 119. The deployment feature would be designed to engage with the expanding gas, wherein the deployment feature would drive the vertical edge of the ballistic barrier curtain 113, 117 axially towards the distal end of the tubular column 524. A curtain deployment dampening member 562 can be assembled with an interior of the tubular column 524 and preferably seated against a column deployment distal stop 561. The curtain deployment dampening member 562 would be employed to de-accelerate the motion of the distal ring 119. It is understood that the configuration of the deployment firing tunnel 528 may vary. In one alternative example, the deployment firing tunnel 528 can be located within the curtain support column 527.

In another embodiment, the inflating poles may include a sealed tube for containment of the initiated gas allowing the curtain to be propelled upward. A pressure relief valve can be provided at a distal end of the inflating pole to discharge any excessive gas.

A upper curtain support ring retention element 564 can be integrated into the tubular column 524, wherein the upper curtain support ring retention element 564 enables the distal ring 119 to pass across the upper curtain support ring retention element 564 during deployment, then retains the distal ring 119 in the desired position once the ballistic barrier curtain 113, 117 is in a deployed condition. The exemplary embodiment presents a biased wedge. The wedge would retract against a biasing force when the distal ring 119 passes the elongated tapered surface. The biasing element would return the wedge to a retaining configuration once the distal ring 119 passes thereby. The distal ring 119 would rest upon a retention element ring support surface 566 of the upper curtain support ring retention element 564. The tubular column 524 can include a firing exhaust port 560 for venting any excess expanding gas to avoid potential damage to the central curtain deployment support column 221 from the expanding gas.

A plurality of audio monitoring systems 180 can be spatially arranged throughout the auditorium to monitor for any unwarranted sounds. The system can monitor for unwarranted sounds, including motion, movement of a trigger, gunfire, and the like. A processing portion of each audio monitoring system 180 is preferably accomplished at the location of the audio monitoring system 180 to minimize time. In a condition where the audio monitoring system 180 detects an unwarranted sound, the audio monitoring system 180 would transmit a directive to the ballistic barrier curtain deployment system 100 to deploy.

At least one visual monitoring system 182 can be located within the auditorium to monitor for any unwarranted motion. The system can monitor for unwarranted motion, including a person standing and aiming a firearm at the speaker 302, and the like. A processing portion of each visual monitoring system 182 is preferably accomplished at the location of the visual monitoring system 182 to minimize time. In a condition where the visual monitoring system 182 detects an unwarranted motion, the visual monitoring system 182 would transmit a directive to the ballistic barrier curtain deployment system 100 to deploy.

At least one heat/thermal monitoring system can be located within the auditorium for detection of any unwarranted heat source, which would be assumed to indicate the launch of a projectile.

A barrier remote activator 400, introduced in FIG. 4, can be employed enabling manual deployment of the ballistic barrier curtain deployment system 100. The barrier remote activator 400 can communicate with the activation controller 240 using wired or wireless technology. The barrier remote activator 400 includes various features carried by an activator casing 410. The barrier remote activator 400 includes a staged status indicator 430 enabling the holder to manually direct deployment of the ballistic barrier curtain deployment system 100. The barrier remote activator 400 can include indicators to identify the condition of the ballistic barrier curtain deployment system 100. The indicators can include a staged status indicator 430 and a deployed status indicator 432 to inform the holder of the current condition of the ballistic barrier curtain deployment system 100.

At least one gas deterrent dispensing element 170, 172 can be positioned in a manner orienting a spray direction towards the audience 102. The at least one gas deterrent dispensing element 170, 172 can be employed to discharge a deterrent dispensed gas 171, 173. The deterrent dispensed gas 171, 173 can be smoke, colored smoke, fog, a noxious gas, tear gas, a flammable gas (preferably provided in a form of a controlled flame), and the like. The deterrent dispensed gas 171, 173 is discharged to provide any of several advantages to the speaker 302. One objective would be to obscure the speaker 302 from view of the audience 102. A second optional objective of the gas deterrent dispensing element 170, 172 would be to disorient the audience 102. A third optional objective of the gas deterrent dispensing element 170, 172 would be to dissuade the audience 102 from approaching the ballistic protective stage 300. The deterrent dispensed gas 171, 173 would be selected based upon the desired objective thereof.

The gas deterrent dispensing element 170, 172 can be modified to include strobing lights, bright lights, and the like to further distract and divert the attention of the audience from the targeted individual/speaker 302. It is understood that the gas deterrent dispensing element 170, 172 can be replaced with a unit that includes strobing lights, bright lights, and the like.

The gas deterrent dispensing element 170, 172 can be modified to include an apparatus to emit a noxious sound to further distract and divert the attention of the audience from the targeted individual/speaker 302. It is understood that the gas deterrent dispensing element 170, 172 can be replaced with a unit that includes the apparatus to emit a noxious sound.

The ballistic barrier curtain deployment system 100 can be placed upon a supporting surface, such as the ground, a deck of a platform 310, and the like. The deployment enclosure base surface 234 would be supported by the supporting surface. The ballistic barrier curtain deployment system 100 can be converted to a portable unit by attaching wheels to the deployment enclosure base surface 234. The wheels can be arranged to ensure adequate support of the ballistic barrier curtain deployment system 100 during transport and use.

The deployment firing mechanisms 250, 252, 550, 552 can utilize any rapid deployment mechanism. The preferred embodiment utilizes airbag technology. It is understood that as airbag technology advances, the same technology advances can be integrated into the deployment firing mechanisms 250, 252, 550, 552.

Although the exemplary concept is illustrated to protect a speaker in an auditorium, it is understood that the ballistic barrier curtain deployment system 100 can be employed to protect military personnel during combat, military equipment, diplomats and other political figures, celebrities, controversial persons/presenters, and the like.

Although the exemplary embodiment presents a system that deploys upwards, it is understood that the system may be mounted from above and deploy downward or even sideways as desired.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A ballistic barrier curtain deployment system comprising:

a barrier curtain storage container having an opening located along an upper portion of a curtain storage section;

a set of ballistic barrier curtain deployment mechanism, each ballistic barrier curtain deployment mechanism in communication with a respective end of the barrier curtain storage container;

each ballistic barrier curtain deployment mechanism comprising:

a curtain deployment support column having a curtain deployment element, wherein the curtain deployment support column is a telescoping column comprising a series of nesting telescoping elements, the series of telescoping elements comprising a curtain support channel extending vertically therethrough, at least one deployment firing mechanism in fluid communication with the curtain deployment support column, an activation controller in signal communication with each of the at least one deployment firing mechanism; and a ballistic barrier curtain having a first vertical deploying edge and a second vertical deploying edge, the first vertical deploying edge in operable communication with the first curtain deployment element, passing through the respective curtain support channel, and the second vertical deploying edge in operable communication with the second curtain deployment element, passing through the respective curtain support channel, wherein in operation, the activation controller directs deployment of the at least one deployment firing mechanism, the at least one deployment firing mechanism discharges a rapid deploying gas which drives the respective ballistic barrier curtain edge towards a distal end of the curtain deployment support column, thus deploying the ballistic barrier curtain.

2. A ballistic barrier curtain deployment system as recited in claim 1, further comprising a primary deployment firing mechanism and a secondary deployment firing mechanism, each of said primary deployment firing mechanism and said secondary deployment firing mechanism being in operational communication with a respective one of said set of ballistic barrier curtain deployment mechanisms.

3. A ballistic barrier curtain deployment system as recited in claim 1, further comprising an inflatable pole that is erected under the direct pressure generated by the initiator.

4. A ballistic barrier curtain deployment system as recited in claim 1, said at least one deployment firing mechanism further comprising a primary deployment firing mechanism and at least one redundant deployment firing mechanism.

5. A ballistic barrier curtain deployment system as recited in claim 1, further comprising a remote control operating device, wherein said remote control operating device is in signal communication with an activation controller to remotely operate said at least one deployment firing mechanism.

6. A ballistic barrier curtain deployment system as recited in claim 1, further comprising a visual monitoring system for providing visual inputs to the operating device.

7. A ballistic barrier curtain deployment system as recited in claim 1, further comprising at least one of a heat monitoring system and a thermal monitoring system for providing identification of temperature differentiations that could be used to identify the launch of a projectile as an input to the device.

8. A ballistic barrier curtain deployment system as recited in claim 1, further comprising an audio monitoring system for providing audio inputs to the operating device.

9. A ballistic barrier curtain deployment system as recited in claim 1, further comprising a gas deterrent dispensing element for dispensing a deterrent gas, wherein said gas deterrent dispensing element dispenses a deterrent gas in conjunction with activation of said ballistic barrier curtain.

10. A ballistic barrier curtain deployment system as recited in claim 1, further comprising an audible deterrent emitting element for emitting a noxious sound, wherein said audible deterrent emitting element emits an audible deterrent in conjunction with activation of said ballistic barrier curtain.

11. A ballistic barrier curtain deployment system as recited in claim 1, wherein said barrier curtain storage container and said deployment mechanism enclosure are designed to be expandable, enabling interconnectivity between a plurality of alternating barrier curtain storage containers and said deployment mechanism enclosures.

12. A ballistic barrier curtain deployment system comprising:

a barrier curtain storage container having an opening located along an upper portion of a curtain storage section;

a set of ballistic barrier curtain deployment mechanism, each ballistic barrier curtain deployment mechanism in communication with a respective end of the barrier curtain storage container;

each ballistic barrier curtain deployment mechanism comprising:

a curtain deployment support column having a curtain deployment element, a curtain support column encased within a tubular column, a series of curtain deployment support rings slideably assembled to the curtain support column, at least one deployment firing mechanism in fluid communication with the curtain deployment support column, an activation controller in signal communication with each of the at least one deployment firing mechanism; and a ballistic barrier curtain having a first vertical deploying edge and a second vertical deploying edge, the first vertical deploying edge in operable communication with the series of curtain deployment support rings slideably assembled to the first curtain deployment element and the second vertical deploying edge in operable communication with the series of curtain deployment support rings slideably assembled to the second curtain deployment element, wherein in operation, the activation controller directs deployment of the at least one deployment firing mechanism, the at least one deployment firing mechanism discharges a rapid deploying gas which drives the respective series of curtain deployment support rings upwards, carrying the respective ballistic barrier curtain edge towards a distal end of the curtain deployment support column, thus deploying the ballistic barrier curtain.

13. A ballistic barrier curtain deployment system as recited in claim 12, further comprising a primary deployment firing mechanism and a secondary deployment firing mechanism, each of said primary deployment firing mechanism and said secondary deployment firing mechanism being in operational communication with a respective one of said set of ballistic barrier curtain deployment mechanisms.

14. A ballistic barrier curtain deployment system as recited in claim 12, said at least one deployment firing mechanism further comprising a primary deployment firing mechanism and at least one redundant deployment firing mechanism.

15. A ballistic barrier curtain deployment system as recited in claim 12, further comprising a remote control operating device, wherein said remote control operating device is in signal communication with an activation controller to remotely operate said at least one deployment firing mechanism.

16. A ballistic barrier curtain deployment system as recited in claim 12, further comprising a visual monitoring system for providing visual inputs to the operating device.

17. A ballistic barrier curtain deployment system as recited in claim 12, further comprising at least one of a heat monitoring system and a thermal monitoring system for providing identification of temperature differentiations that could be used to identify the launch of a projectile as an input to the device.

18. A ballistic barrier curtain deployment system as recited in claim 12, further comprising an audio monitoring system for providing audio inputs to the operating device.

19. A ballistic barrier curtain deployment system as recited in claim 12, further comprising a gas deterrent dispensing element for dispensing a deterrent gas, wherein said gas deterrent dispensing element dispenses a deterrent gas in conjunction with activation of said ballistic barrier curtain.

20. A ballistic barrier curtain deployment system as recited in claim 12, further comprising an audible deterrent emitting element for emitting a noxious sound, wherein said audible deterrent emitting element emits an audible deterrent in conjunction with activation of said ballistic barrier curtain.

* * * * *